US009828859B2

(12) United States Patent
Yokoyama

(10) Patent No.: US 9,828,859 B2
(45) Date of Patent: Nov. 28, 2017

(54) GAS TURBINE BLADE WITH INNER AND OUTER COOLING HOLES

(71) Applicant: Mitsubishi Hitachi Power Systems, Ltd., Yokohama (JP)

(72) Inventor: Takashi Yokoyama, Tokyo (JP)

(73) Assignee: Mitsubishi Hitachi Power Systems, Ltd., Yokohama (JP)

( * ) Notice: Subject to any disclaimer, the term of this patent is extended or adjusted under 35 U.S.C. 154(b) by 633 days.

(21) Appl. No.: 14/168,597

(22) Filed: Jan. 30, 2014

(65) Prior Publication Data

US 2014/0255208 A1 Sep. 11, 2014

(30) Foreign Application Priority Data

Mar. 5, 2013 (JP) ..... 2013-042496

(51) Int. Cl.
*F01D 5/18* (2006.01)
*F01D 5/20* (2006.01)

(52) U.S. Cl.
CPC ..... *F01D 5/186* (2013.01); *F01D 5/20* (2013.01)

(58) Field of Classification Search
CPC ..... F01D 5/186; F01D 5/20
See application file for complete search history.

(56) References Cited

U.S. PATENT DOCUMENTS

| | | | |
|---|---|---|---|
| 6,056,507 | A | 5/2000 | Wheat et al. |
| 2003/0021684 | A1 | 1/2003 | Downs et al. |
| 2003/0059304 | A1 | 3/2003 | Leeke et al. |
| 2004/0151586 | A1 | 8/2004 | Chlus et al. |
| 2005/0063824 | A1 | 3/2005 | Boury et al. |
| 2006/0257257 | A1 | 11/2006 | Deschamps et al. |
| 2007/0237637 | A1 | 10/2007 | Lee et al. |
| 2010/0254823 | A1 | 10/2010 | Boury et al. |

FOREIGN PATENT DOCUMENTS

| | | | |
|---|---|---|---|
| CN | 1408988 | A | 4/2003 |
| CN | 1519458 | A | 8/2004 |
| CN | 1861988 | A | 11/2006 |
| CN | 1920258 | A | 2/2007 |
| EP | 1 057 970 | A2 | 12/2000 |
| EP | 1 281 837 | A1 | 2/2003 |

(Continued)

OTHER PUBLICATIONS

Chinese Office Action dated Mar. 19, 2015 (Six (6) pages).

(Continued)

*Primary Examiner* — Ryan J Walters
(74) *Attorney, Agent, or Firm* — Crowell & Moring LLP

(57) ABSTRACT

The gas turbine blade includes a cooling channel formed therein, and a partition disposed on its tip side for isolating the cooling channel from the outside. The partition is integrally formed with a blade portion in a position on its inner side in the radial direction with respect to the tip of the gas turbine blade. Reinforcements are provided on the outer side of the partition in the radial direction and on the inner side of the tip end wall extended from the blade portion to connect the partition with the tip end wall. Outer surface cooling holes are formed to extend from the cooling channel into communication with an outer surface of the tip end wall, and inner surface cooling holes are formed to extend from the cooling channel into an inner surface of the tip end wall through the partition.

9 Claims, 8 Drawing Sheets

(56) References Cited

FOREIGN PATENT DOCUMENTS

| | | | |
|---|---|---|---|
| EP | 1 505 258 | A1 | 2/2005 |
| EP | 1 762 701 | A2 | 3/2007 |
| JP | 2005-54799 | A | 3/2005 |

OTHER PUBLICATIONS

Japanese-language Office Action issued in counterpart Japanese Application No. 2013-042496 dated Jul. 19, 2016 with English translation (5 pages).
European Search Report dated Mar. 31, 2014 (Six (6) pages).

GAS TURBINE BLADE WITH INNER AND OUTER COOLING HOLES

CLAIM OF PRIORITY

The present application claims priority from Japanese Patent application serial no. 2013-042496, filed on Mar. 5, 2013, the content of which is hereby incorporated by reference into this application.

FIELD OF THE INVENTION

The present invention relates to gas turbines, and more specifically, a gas turbine blade having a cooling structure.

BACKGROUND OF THE INVENTION

The efficiency of a gas turbine is improved together with an increase in combustor outlet temperature or turbine inlet temperature. The combustor outlet temperature of the current gas turbine reaches 1500° C. The temperature of the surface of a gas turbine blade exposed to the high-temperature combustion gas exceeds a limit temperature of a heat-resistant alloy used, which requires cooling of the gas turbine blade.

Air extracted from a compressor is supplied to a cooling channel formed in the gas turbine blade, and subjected to convection cooling. The air is injected from the cooling channel to the surface of the gas turbine blade via through holes set in the blade surface and flows over the blade surface to perform film cooling, thereby suppressing an increase in temperature of the gas turbine blade to decrease the temperature to the limit temperature or less. However, there are some positions of the blade where film cooling holes are difficult to be effectively arranged due to the restrictions on the shape and manufacturing of the blade, and the like.

In the tip of the gas turbine blade, a combustion gas might leak in clearance between the blade tip and an inner surface of a casing in the radial direction, leading to a loss in work of the turbine. In order to reduce the loss, the clearance is designed to be minimum. Upon start-up of the gas turbine, however, a difference in thermal expansion between the gas turbine blade and the casing might be caused due to a difference in temperature between the blade and casing generated in stopping of the turbine, so that the blade tip might be brought into contact with the casing to be worn. Thus, the tip of the gas turbine blade generally has a partition for isolating the cooling channel formed in the blade from the outside and a blade portion extending from the partition in the direction of the outer diameter to form a tip end wall, which serves as a wear allowance.

The tip end wall, however, is spaced apart from the cooling channel formed in the gas turbine blade, which makes it difficult to cool the blade tip even though the film cooling holes are provided from the cooling channel toward the blade tip. In particular, the surface of a space between the adjacent holes is very difficult to be cooled. Although the clearance between the blade tip and the casing in the radial direction is designed to be minimum, another clearance might be generated with the progress of the wear of the tip end wall. When the combustion gas invades the inner surface side of the tip end wall, the inner surface of the tip end wall would also be exposed to the combustion gas, causing damage to the tip end wall due to oxidation or the like.

In contrast, Japanese Unexamined Patent Publication No. 2005-54799 (see FIG. 4) (Patent Document 1) discloses a structure which includes a reinforcement disposed on an inner surface side of a tip end wall of each blade to thereby suppress the generation of local stress in forming film cooling holes at the tip end wall (see Patent Document 1).

The technique disclosed in Patent Document 1 expects the outer surface of the tip end wall to be cooled. However, the reinforcements are uniformly provided over its inner surface side of the tip end wall. Thus, the thickness of the tip end wall is increased, resulting in an increase in thermal capacity of the tip end wall, which is disadvantageous from the viewpoint of suppressing the increase in temperature of the inner surface. When the reinforcements are provided in a cycle corresponding to positions of the film cooling holes, a superficial area of the inner surface of the blade is increased to promote the heat transfer from the inner surface. Thus, the difference in temperature between the inner and outer surfaces of the tip end wall can be increased to generate the thermal stress.

When the film cooling holes are provided toward the tips of the blades, the cooled air is not brought into contact with the outer surface of the blade between the adjacent holes, making it difficult to uniformly cool the tip end wall from a leading edge of the blade to a trailing edge thereof. Techniques for resisting higher temperatures need to be developed in the future.

Accordingly, it is an object of the present invention to provide a gas turbine blade that suppresses the generation of a local stress by provision of cooling holes, while suppressing a difference in temperature between inner and outer surfaces of the tip end wall of the blade.

SUMMARY OF THE INVENTION

In order to solve the foregoing problems, the present invention provides a gas turbine blade which includes: a cooling channel formed in a gas turbine blade; a partition disposed on a tip side of the blade for isolating the cooling channel from an outside of the blade; a tip end wall formed to extend from a tip of a blade portion toward the outside in a radial direction; a plurality of reinforcements provided along a boundary between an outer surface of the partition and an inner surface of the tip end wall, the reinforcements being spaced apart from each other; a plurality of outer surface cooling holes extending from the cooling channel into communication with an outer surface of the blade portion; and a plurality of inner surface cooling holes extending from the cooling channel into communication with an inner surface of the tip end wall through the partition.

According to the invention, the gas turbine blade is provided which can suppress the occurrence of a local stress caused by formation of cooling holes, while suppressing the difference in temperature between the inner and outer surfaces of the tip end wall of the blade.

DETAILED DESCRIPTION OF THE PREFERRED EMBODIMENTS

Figure 13:
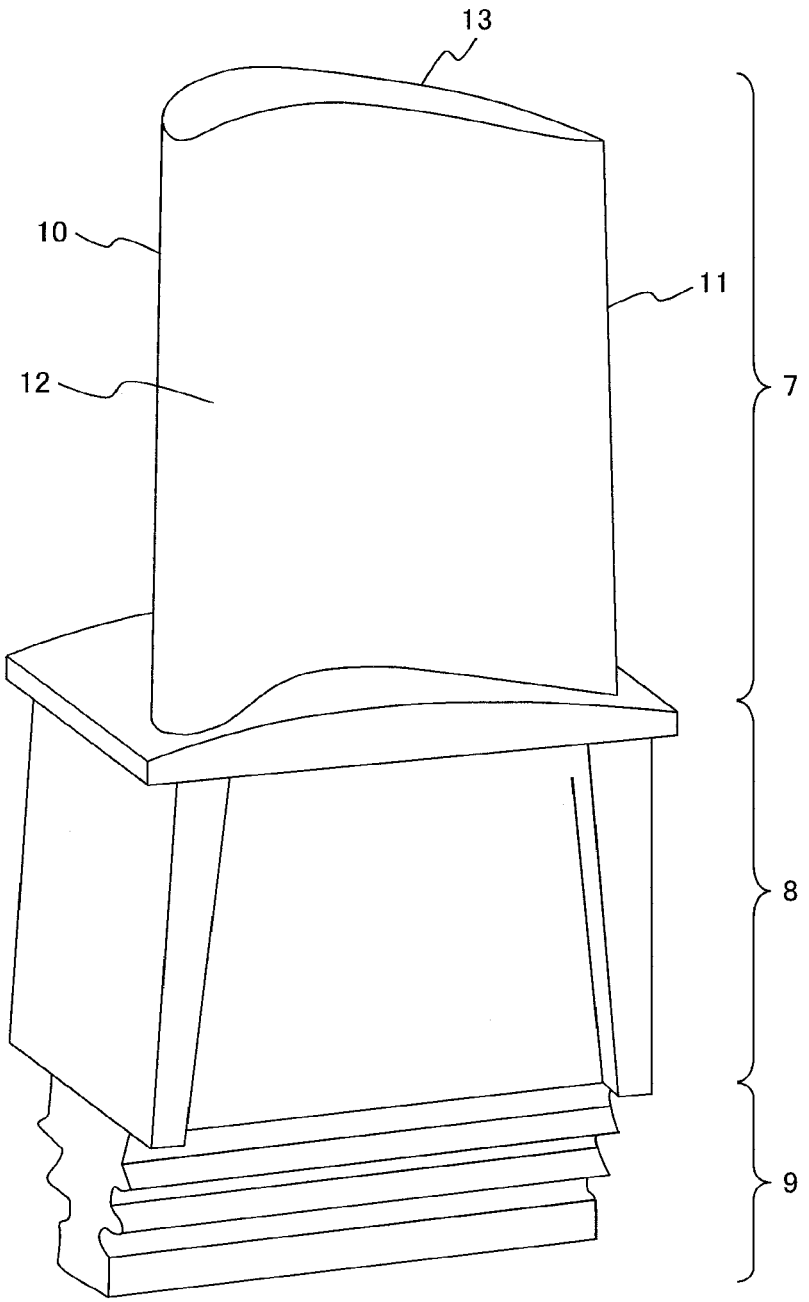
FIG. 13 is a diagram showing an example of a gas turbine blade structure including film cooling holes.
Figure 14:
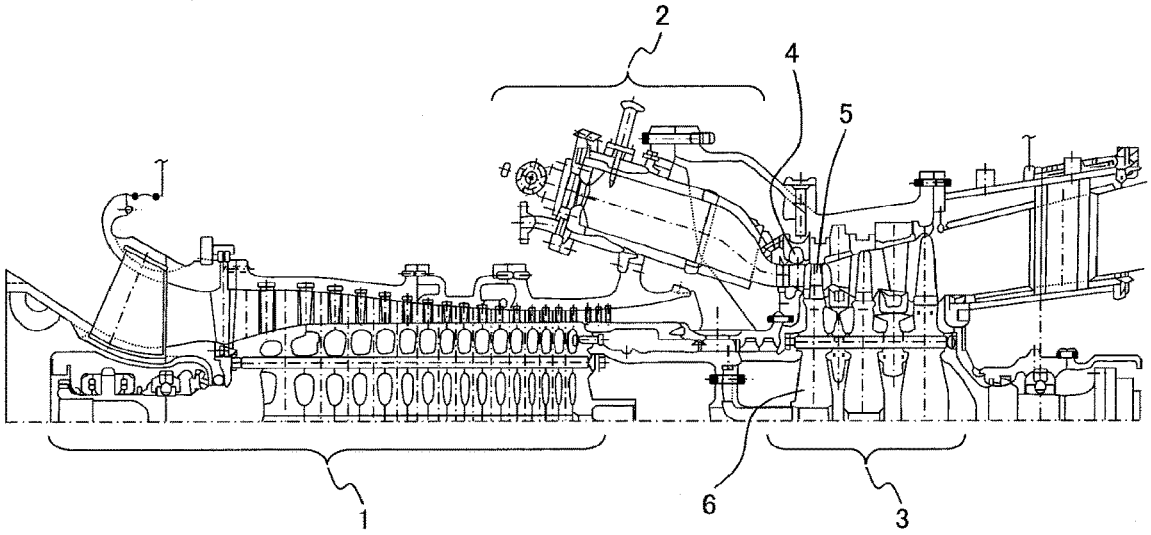
PRIOR ART FIG. 14
FIG. 14 is a diagram of an example of a typical gas turbine structure.

FIG. 14 shows a cross-sectional view of a typical structure of a gas turbine. FIG. 13 shows an example of the gas turbine blade structure including cooling holes.

The gas turbine mainly includes a compressor 1, a combustor 2, and a turbine 3. The compressor 1 performs adiabatic compression on air sucked from the atmosphere as a working fluid. The combustor 2 burns the mixture of fuel and the compressed air supplied from the compressor 1 to form a high-temperature and high-pressure gas. The turbine 3 generates a rotation power from the combustion gas introduced thereinto from the combustor 2 in expansion of the gas. The exhaust gas from the turbine 3 is discharged into the atmosphere.

Generally, rotor blades 4 and stator blades 5 of the gas turbine are alternately arranged in the direction of the turbine axis, and implanted in grooves provided on the outer periphery of a wheel 6. Each of the rotor blades 4 shown in FIG. 13 includes a blade portion 7, a platform 8, and a dovetail 9. The blade portion 7 includes a concave pressure side portion 12 and a convex suction side portion 13 separated by a boundary between a leading edge 10 first receiving the combustion gas and a trailing edge 11 discharging therefrom the combustion gas. The blade tip has a partition 14 for isolating the inside of the blade portion from the outside. A tip end wall (to be described later) is provided to extend from the partition toward each of the pressure side and suction side of the blade.

The gas turbine tends to be subjected to high temperatures in order to improve its efficiency. The superficial temperature of the gas turbine blade exposed to the high-temperature combustion gas exceeds a limit temperature of heat-resistant alloy used, which requires the cooling of the gas turbine blade. One of cooling methods of a gas turbine blade involves guiding air extracted from an intermediate stage or outlet of the compressor 1 into the cooling channel formed in the blade to thereby cool the air by convective heat transfer through a wall of the channel. Another method involves forming in the blade portion 7, cooling holes for connecting a cooling channel inside the blade with the outside of the blade, and injecting cooled air from the cooling holes to cover the blade surface with the cooled air to thereby perform film cooling.

The film cooling holes are provided in a leading edge 11, a pressure side portion 12, a suction side portion 13, and a tip of the blade portion 7, the platform 8, and the like. The tip end wall provided in the tip, however, is spaced apart from the cooling channel formed in the blade. Even when the film cooling hole 17 is provided to be directed from the cooling channel 16 toward the blade tip, the blade tip is difficult to be cooled. Reinforcements are provided on the inner surface of the tip end wall, so that an opening for each film cooling hole can be formed close to the blade tip from the viewpoint of strength. To promote cooling of the blade tip, the shape of the reinforcement or the arrangement of the film cooling holes remains an issue.

In the following, preferred embodiments of the invention will be described with reference to the accompanying drawings.

FIGS. 1 to 4 illustrate a cooling structure of the tip of the gas turbine blade representing most the features of the invention. The turbine blade 4 of this embodiment includes a tip end wall 15 extending outward in the radial direction from the tip of the blade portion 7. The turbine blade 4 also includes outer surface cooling holes 17 making the cooling channel 16 formed in the gas turbine blade communicate with a tip end wall outer surface 15*a* (space outside the blade), and inner surface cooling holes 18 making the cooling channel 16 communicate with a tip end wall inner surface 15*b* via the partition 14. The inner surface cooling hole 18 is disposed in communication with the tip end wall inner surface 15*b* (space outside the blade) between two adjacent reinforcements 19 formed at equal intervals together with the outer surface cooling holes 17. The reinforcements 19 are provided spaced apart from each other at the boundary between the outer surface of the partition 14 and the inner surface of the tip end wall 15. An opening for the inner surface cooling hole 18 is provided in the partition 14, allowing the cooling medium to be injected therefrom along or toward the inner surface of the tip end wall 15. An opening for the outer surface cooling hole 17 is provided in the tip end wall outer surface 15*a*. The outer surface cooling hole 17 is disposed to have its part (hole part penetrating the partition 14) superimposed over an arrangement area of the reinforcement 19 as viewed from the outside of the blade portion 7 in the radial direction.

The reinforcement 19 and the partition 14 can be integrally casted with the blade portion 7. Alternatively, the partition 14 can be separately formed from the reinforcement 19 and the blade portion 17, and then can be bonded together by a method, such as welding, as will be described later. The outer surface cooling holes 17 and the inner surface cooling holes 18 are processed by electrical discharge machining or the like after forming the blade.

Figure 1:
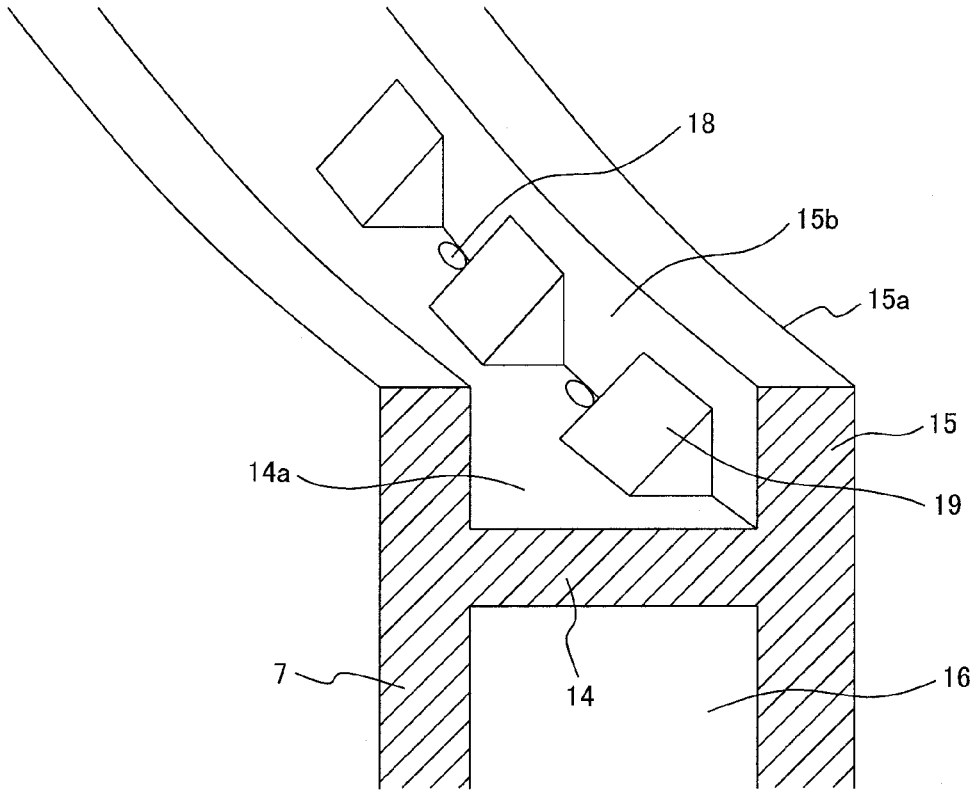
FIG. 1 is a perspective view showing a first embodiment of the invention.
Figure 2:
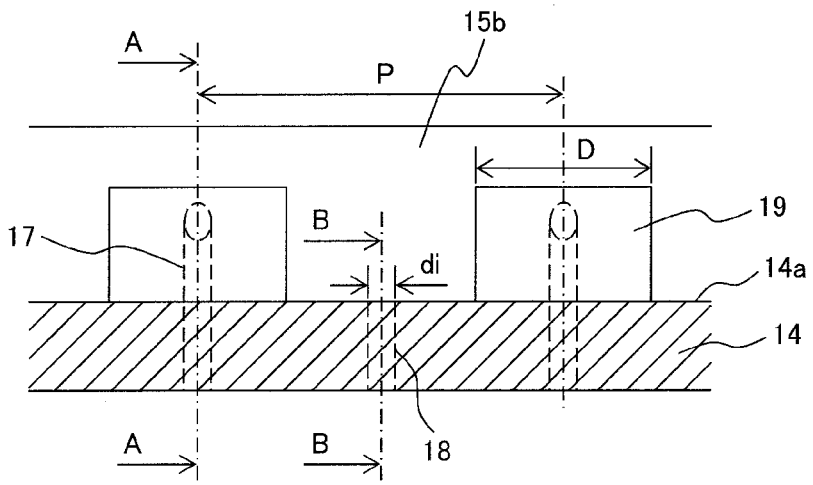
FIG. 2 is a perspective view of an inner surface of a pressure side tip end wall as viewed from an inner surface of a suction side tip end wall in the first embodiment of the invention.
Figure 3:
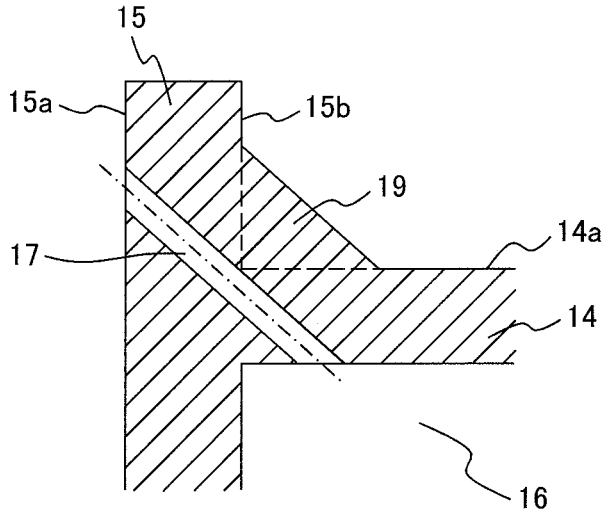
FIG. 3 is a cross-sectional view taken along the line A-A of FIG. 2.
Figure 4:
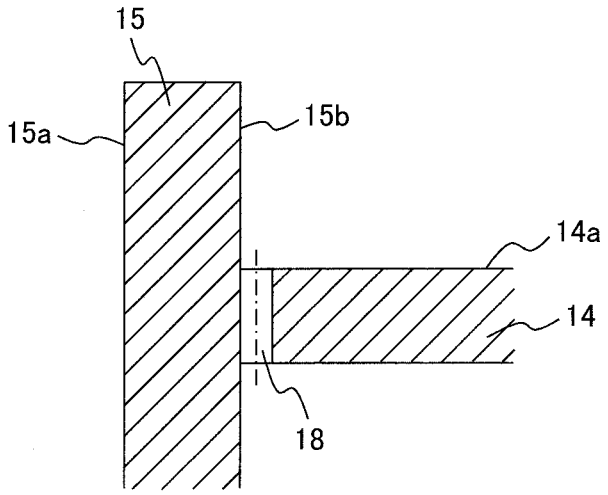
FIG. 4 is a cross-sectional view taken along the line B-B of FIG. 2.

FIG. 1 shows the settings at the pressure side portion 12. The suction side portion 13 can be set in the same way.

According to the embodiment described above, the formation of the reinforcements 19 can position the outer surface cooling holes 17 near the blade tip, and the inner surface cooling holes 18 can be set at the same time, which further reduces the temperature of the tip end wall 15 to suppress the damage to the tip end wall 15 due to the oxidation of the wall by the combustion gas. Each of the inner surface cooling holes 18 is disposed in the middle between the adjacent reinforcements 19 to be brought into communication with the tip end wall inner surface 15*b*, which makes it possible to cool the intermediate part of the outer surface cooling hole 17 from its inner surface side even though the cooling hole 17 is difficult to be cooled. Thus, the difference in temperature between the inner and outer surfaces of the tip end wall can be reduced, resulting in the state close to the uniform temperature distribution. In order to achieve the above arrangement, referring to FIG. 2, when P is a distance between the central axes of the adjacent outer surface cooling holes 17, D is a width of the reinforcement 19, and di is a diameter of the inner surface cooling hole 18, the following formula needs to be satisfied: P≥D+di. This can reduce the thermal stress generated due to the local temperature distribution to thereby suppress the occurrence of cracks from the outer surface cooling hole 17 and the inner surface cooling hole 18.

The above structure can reduce the breakage of the tip end wall 15 due to the oxidation or cracks, and can suppress the reduction in blade life and the degradation of the performance of the turbine.

Figure 5:
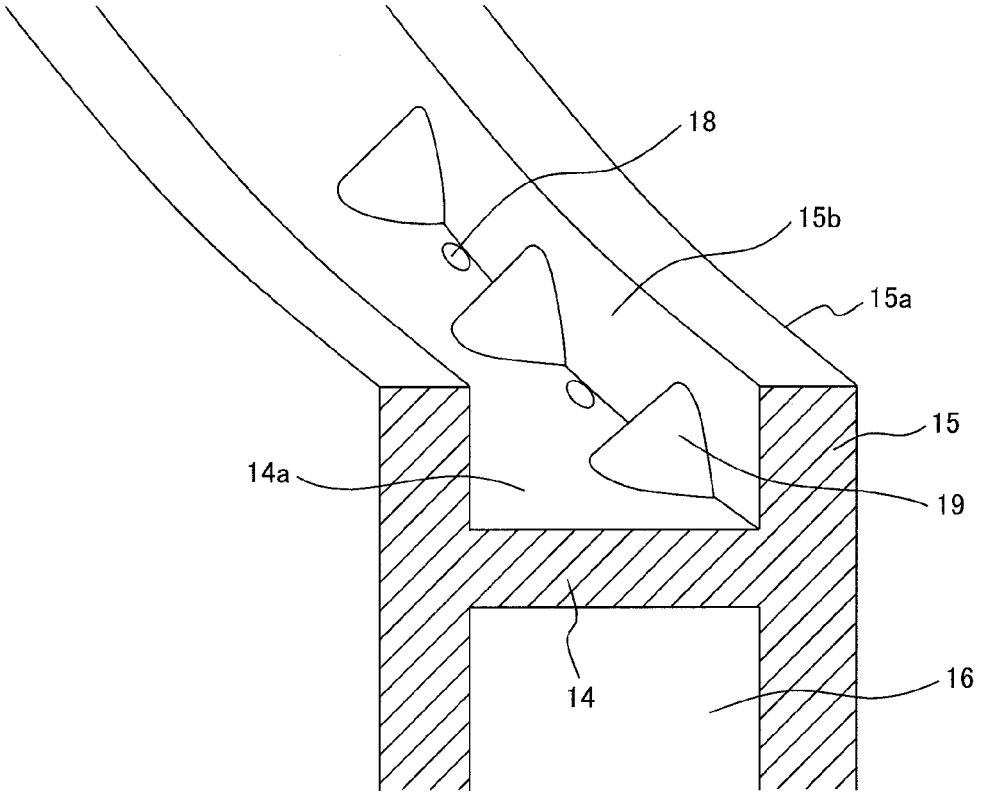
FIG. 5 is a perspective view showing a second embodiment of the invention.
Figure 6:
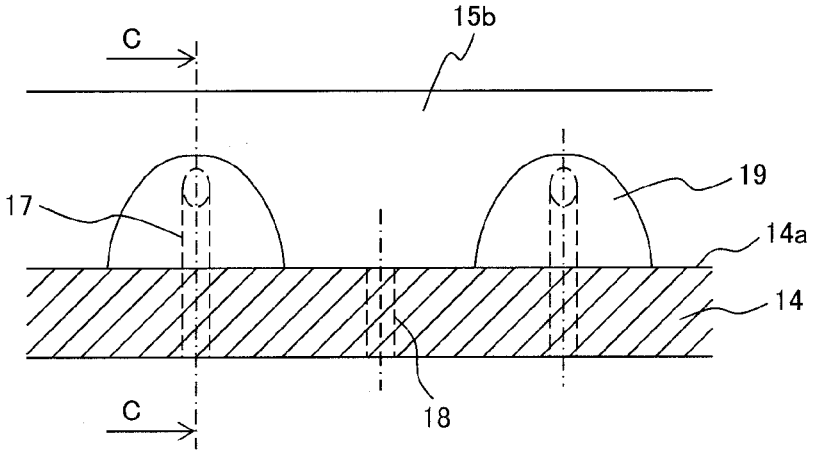
FIG. 6 is a perspective view of an inner surface of a pressure side tip end wall as viewed from an inner surface of a suction side tip end wall in the second embodiment of the invention.
Figure 7:
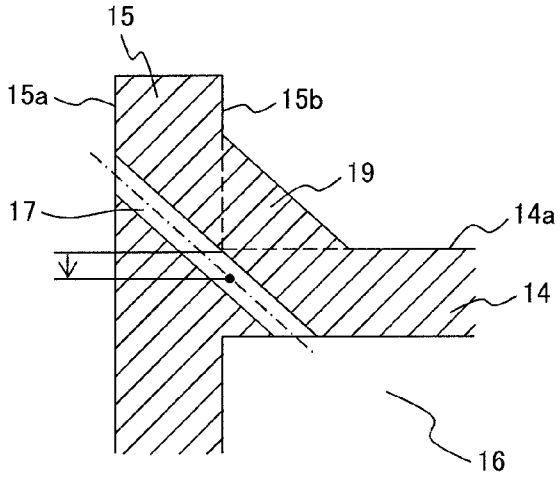
FIG. 7 is a cross-sectional view taken along the line C-C of FIG. 6.

FIGS. 5 to 7 show a cooling structure at the tip of a gas turbine blade in a second embodiment of the invention. In this embodiment, the turbine blade 4 includes the outer surface cooling holes 17 extending from the cooling channel 16 formed in the gas turbine blade into communication with the tip end wall outer surface 15*a*, and the inner surface cooling holes 18 extending from the cooling channel 16 into communication with the tip end wall inner surface 15*b* via the partition 14. The reinforcement 19 has a cylindrical shape arranged coaxially with respect to the central axis of the outer surface cooling hole 17, and each of the inner surface cooling holes 18 is disposed in communication with the middle between the adjacent reinforcements 19.

Figure 8:
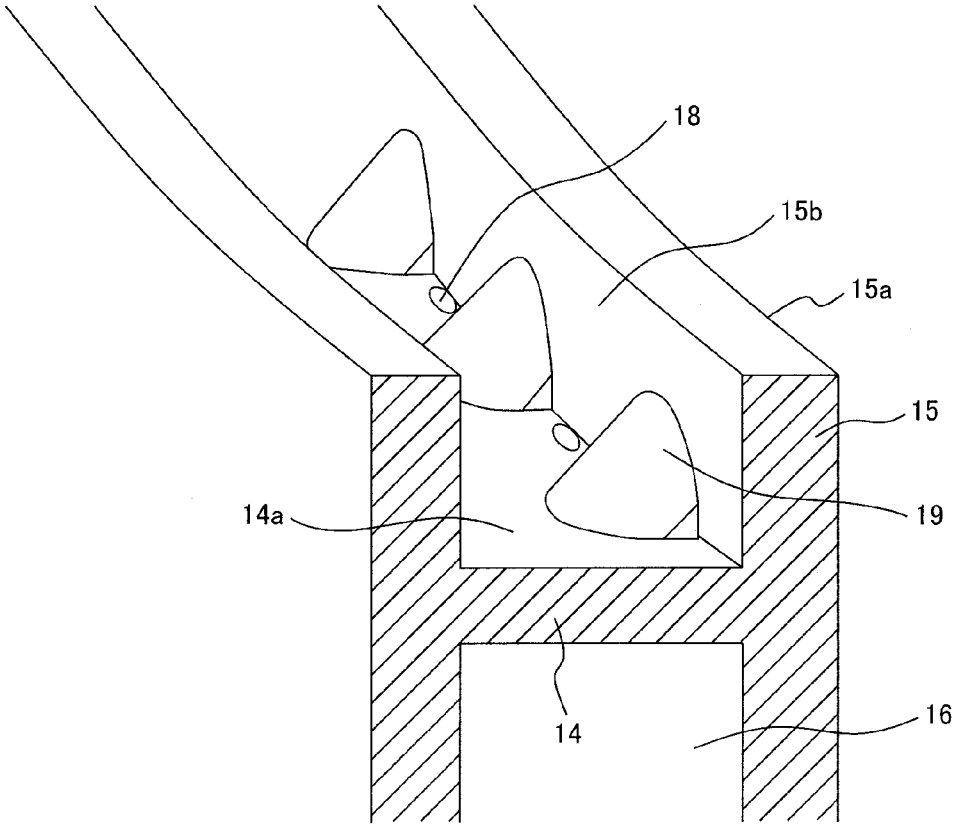
FIG. 8 is a perspective view showing the second embodiment of the invention.
Figure 9:
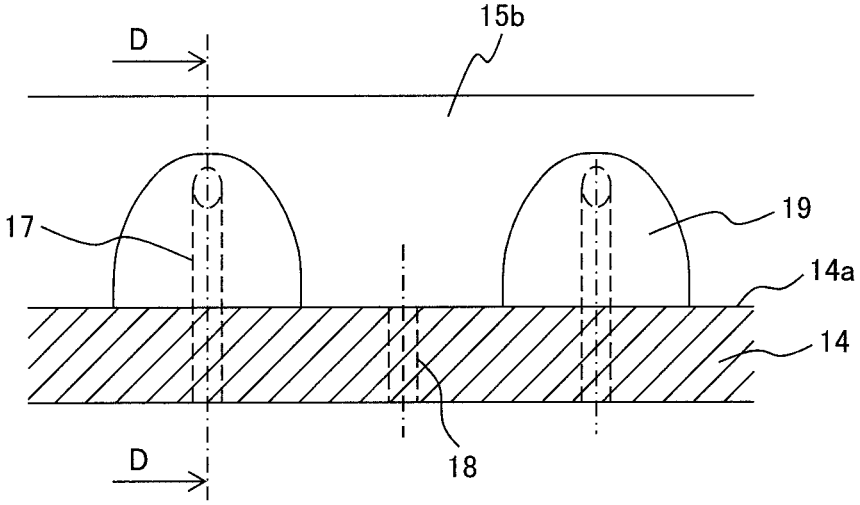
FIG. 9 is a perspective view of the inner surface of the pressure side tip end wall as viewed from the inner surface of the suction side tip end wall in the second embodiment of the invention.
Figure 10:
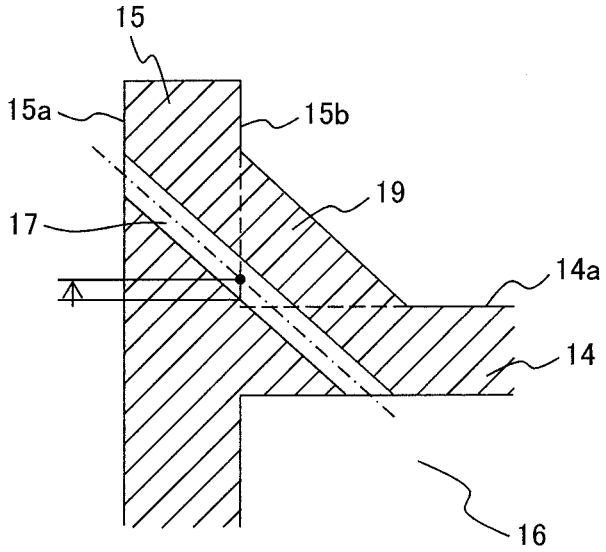
FIG. 10 is a cross-sectional view taken along the line D-D of FIG. 9.

As shown in FIG. 10, the cylindrical reinforcement 19 takes the following forms when the central axis of the outer surface cooling hole 17 is positioned in an outer diameter direction with respect to a line of intersection of a surface forming an inner surface 15*b* of the tip end wall 15 and a surface forming an outer surface 14*a* of the partition 14. As shown in FIGS. 8 to 10, the reinforcement 19 positioned in the outer diameter direction with respect to the central axis of the outer surface cooling hole 17 is cylindrical, and the reinforcement 19 positioned in the inner diameter direction with respect to the central axis of the outer surface cooling hole 17 is rectangular.

In the embodiment described above, the reinforcement 19 is formed in a cylindrical shape, which can reduce an increase in volume of the tip end wall 15 and an increase in thermal capacity caused by the setting of the reinforcement 19 to the minimum. The effect of cooling from the surface by the film cooling can be expected to be exhibited inside the tip end wall 15. Further, an increase in superficial area of the tip end wall 15 can be suppressed by the setting of the reinforcement 19, and the heat transfer can be suppressed from the surface of the reinforcement 15. These features make the effects of the first embodiment remarkable.

Figure 11:
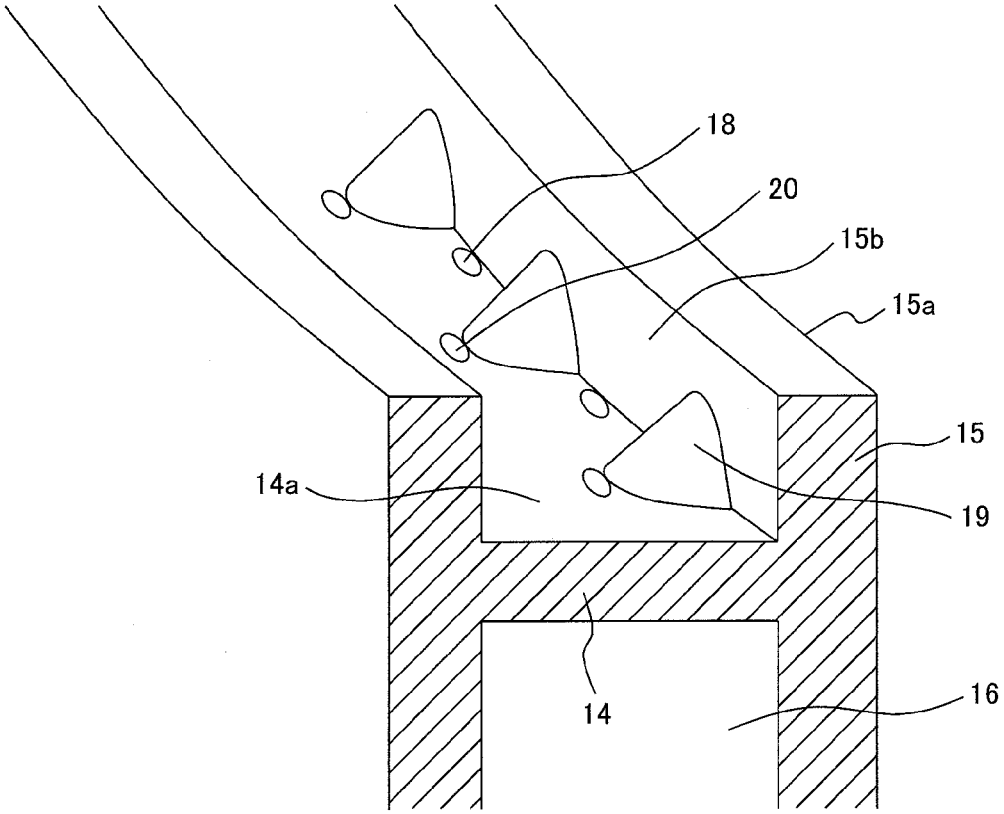
FIG. 11 is a perspective view showing a third embodiment of the invention.

FIG. 11 shows a cooling structure at the tip of a gas turbine blade in a third embodiment of the invention. In this embodiment, the turbine blade 4 includes the outer surface cooling holes 17 extending from the cooling channel 16 formed in the gas turbine blade into communication with the tip end wall outer surface 15*a*, and the inner surface cooling holes 18 extending from the cooling channel 16 into communication with the tip end wall inner surface 15*b* via the partition 14. Further, inner surface cooling holes 20 are formed to extend from the cooling channel 16 in communication with the reinforcements 19 through the partition 14.

In the embodiment described above, the cooled air is in communication with not only the outer surface cooling holes 17 and the inner surface cooling holes 18, but also the surface of each of the reinforcements 19 having a high thermal capacity and a large superficial area, which can promote the cooling of the tip end wall 15 to make the temperature distribution of the tip end wall more uniform.

Figure 12:
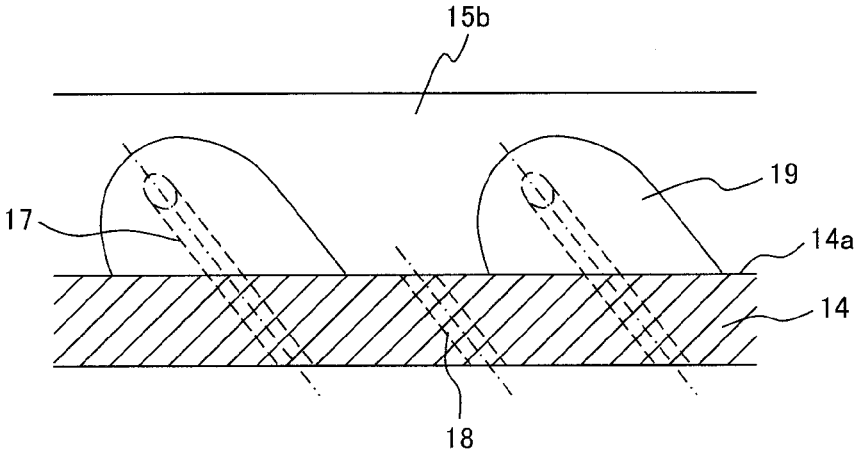
FIG. 12 is a perspective view showing an inner surface of a pressure side tip end wall as viewed from an inner surface of a suction side tip end wall in a fourth embodiment of the invention.

FIG. 12 shows a cooling structure at the tip of a gas turbine blade in a fourth embodiment of the invention. In this embodiment, the turbine blade 4 includes the outer surface cooling holes 17 extending from the cooling channel 16 formed in the gas turbine blade into communication with the tip end wall outer surface 15*a* through the inside of the reinforcements 19, and the inner surface cooling holes 18 extending from the cooling channel 16 into communication with the tip end wall inner surface 15*b* via the partition 14. An opening for the outer surface cooling hole 17 at the tip end wall outer surface 15*a*, and an opening for the inner surface cooling hole 18 at the partition outer surface 14*a* are positioned on the trailing edge side with respect to an opening of the cooling channel 16.

In the embodiment described above, the film cooling is performed by injecting the cooled air toward the trailing edge, so that the cooled air flow in the trailing edge direction can be formed at the surface of the tip end wall 15. Thus, the cooled air can be sent to the trailing edge of the outer surface of the blade where a cooling hole is not formed easily, which can suppress the damage to the trailing edge due to the oxidation.

According to the respective embodiments described above, the reinforcements are provided on the inner surface side of the tip end wall of the blade, so that the opening for the outer surface cooling hole can be positioned close to the tip of the tip end wall of the blade. The reinforcements having a cylindrical shape are disposed in a cycle to thereby reduce the increase in thickness of the tip end wall and the increase in superficial area of the inner surface of the tip end wall to the minimum, which can reduce the occurrence of the difference in temperature between the inner and outer surfaces of the tip end wall.

The inner surface cooling holes are provided to be opened on the inner surface side of the tip end wall, and thus can cool the inner and outer surfaces of the tip end wall to suppress the occurrence of the difference in temperature between the inner and outer surfaces. The opening for the inner surface cooling hole is located in the middle between the adjacent openings of the outer surface cooling holes, which promotes cooling of an area between the adjacent outer surface cooling holes to make the temperature distribution of the tip end wall uniform.

The above arrangement can suppress the damage to the tip end wall due to the oxidation by the combustion gas, while suppressing the local stress accompanied by the formation of the cooling holes together with the temperature distribution of the tip end wall, thereby suppressing the occurrence of cracks from the cooling holes.

What is claimed is:

1. A gas turbine blade, comprising:

a cooling channel formed in the gas turbine blade;

a partition disposed on a tip side of the blade for isolating the cooling channel from an outside of the blade;

a tip end wall formed to extend from a tip of a blade portion toward the outside in a radial direction;

a plurality of reinforcements provided along a boundary between an outer surface of the partition and an inner surface of the tip end wall, the reinforcements being spaced apart from each other;

a plurality of outer surface cooling holes extending from the cooling channel into communication with an outer surface of the blade portion; and a plurality of inner surface cooling holes extending from the cooling channel into communication with the inner surface of the tip end wall through the partition, wherein at least one of the plurality of inner surface cooling holes is disposed between adjacent reinforcements, one of said outer surface cooling holes is disposed to have a part superimposed over an arrangement area of one of said reinforcements when viewing the blade portion from the outside in the radial direction, the reinforcements are integrally casted or bonded to the partition outer surface and the tip end wall inner surface, and the one of said outer surface cooling holes passes through the partition and the tip end wall from the cooling channel and communicates with the outer surface of the blade portion.

2. The gas turbine blade according to claim 1, wherein the at least one of the plurality of inner surface cooling holes is in communication with the cooling channel and a space outside the blade.

3. The gas turbine blade according to claim 2, wherein a cooling medium is injected from the at least one of the inner surface cooling holes along the inner surface of the tip end wall or toward the inner surface of the tip end wall.

4. The gas turbine blade according to claim 1, wherein the outer surface cooling hole has an opening formed at an outer surface of the tip end wall.

5. The gas turbine blade according to claim 4, wherein the central axis of the plurality of outer surface cooling holes is positioned in an outer diameter direction with respect to a line of intersection of a surface forming an inner surface of the tip end wall and a surface forming an outer surface of the partition, and wherein the reinforcement positioned in the outer diameter direction with respect to the central axis of the plurality of outer surface cooling holes is cylindrical, and the reinforcement positioned in the inner diameter direction with respect to the central axis of the plurality of outer surface cooling holes is rectangular.

6. The gas turbine blade according to claim 1, wherein a distance between central axes of an adjacent outer surface cooling holes is equal to or more than a sum of a diameter of the at least one of the plurality of inner surface cooling holes and a width of the reinforcement in a position where the reinforcement intersects with the partition.

7. The gas turbine blade according to claim 1, wherein the plurality of reinforcements have a cylindrical shape disposed coaxially with respect to the central axis of the plurality of outer surface cooling holes.

8. The gas turbine blade according to claim 1, wherein the central axis of any or all of the outer surface cooling holes and the at least one of the plurality of inner surface cooling holes is inclined in the direction toward a trailing edge of the blade.

9. A gas turbine blade, comprising:

a cooling channel formed in the gas turbine blade;

a partition disposed on a tip side of the blade for isolating the cooling channel from an outside of the blade;

a tip end wall formed to extend from a tip of a blade portion toward the outside in a radial direction;

a plurality of reinforcements provided along a boundary between an outer surface of the partition and an inner surface of the tip end wall, the reinforcements being spaced apart from each other;

a plurality of outer surface cooling holes extending from the cooling channel into communication with an outer surface of the blade portion; and a plurality of inner surface cooling holes extending from the cooling channel into communication with the inner surface of the tip end wall through the partition, wherein an outer surface cooling hole is disposed to have a part superimposed over an arrangement area of a reinforcement when viewing the blade portion from the outside in the radial direction, the outer surface cooling hole has an opening formed at an outer surface of the tip end wall, the central axis of the plurality of outer surface cooling holes is positioned in an outer diameter direction with respect to a line of intersection of a surface forming an inner surface of the tip end wall and a surface forming an outer surface of the partition, and the reinforcement positioned in the outer diameter direction with respect to the central axis of the plurality of outer surface cooling holes is cylindrical, and the reinforcement positioned in the inner diameter direction with respect to the central axis of the plurality of outer surface cooling holes is rectangular.

* * * * *